US008695863B2

(12) United States Patent
Francis

(10) Patent No.: US 8,695,863 B2
(45) Date of Patent: Apr. 15, 2014

(54) REINFORCED PLASTIC SLEEVE FOR PNEUMATIC NAILER

(75) Inventor: Ryan L. Francis, Palatine, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 338 days.

(21) Appl. No.: 13/104,709

(22) Filed: May 10, 2011

(65) Prior Publication Data

US 2012/0286016 A1 Nov. 15, 2012

(51) Int. Cl.
*B27F 7/02* (2006.01)

(52) U.S. Cl.
USPC ..... 227/130; 227/10; 92/128; 92/212

(58) Field of Classification Search
USPC ..... 227/130, 10, 8, 156; 92/52, 128, 163, 92/164, 212, 222, 248, 224
See application file for complete search history.

(56) References Cited

U.S. PATENT DOCUMENTS

| | | | | |
|---|---|---|---|---|
| 3,638,532 | A | 2/1972 | Novak | |
| 4,336,868 | A * | 6/1982 | Wilson et al. | 188/376 |
| 4,440,069 | A * | 4/1984 | Holtzberg et al. | 92/224 |
| 4,683,810 | A * | 8/1987 | Afimiwala | 92/212 |
| 5,669,284 | A * | 9/1997 | Fish | 92/128 |
| 6,457,624 | B1 * | 10/2002 | Weihrauch | 227/10 |
| 6,604,664 | B2 | 8/2003 | Robinson | |
| 6,640,541 | B2 * | 11/2003 | Winkelmann et al. | 60/533 |
| 7,204,402 | B2 * | 4/2007 | Burke et al. | 227/8 |
| 7,412,920 | B2 * | 8/2008 | Fish | 92/128 |
| 7,493,849 | B2 * | 2/2009 | Macht et al. | 92/169.1 |
| 7,503,473 | B2 * | 3/2009 | Niblett et al. | 227/130 |
| 7,527,106 | B2 * | 5/2009 | Miller et al. | 173/1 |
| 7,819,137 | B2 * | 10/2010 | Nelson et al. | 137/625.4 |
| 8,136,758 | B2 * | 3/2012 | Steinke et al. | 244/100 R |

* cited by examiner

*Primary Examiner* — Scott A. Smith
(74) *Attorney, Agent, or Firm* — Greer, Burns & Crain, Ltd.; Maurice E. Finnegan, III; Mark W. Croll

(57) ABSTRACT

A sleeve for a pneumatic nailer is provided that includes a cylindrical tubular body made of plastic and having a lower edge; and a metal reinforcing ring is integrally secured to the lower edge.

9 Claims, 3 Drawing Sheets

REINFORCED PLASTIC SLEEVE FOR PNEUMATIC NAILER

BACKGROUND

The present invention relates to fastener driving tools, and more particularly to pneumatically powered fastener drivers, also referred to as pneumatic nailers.

In conventional pneumatic nailers, such as those disclosed in U.S. Pat. Nos. 3,638,532; 6,604,664 and pending application Ser. No. 13/037,872 incorporated by reference, the nailer is pressed down upon a workpiece needing a fastener, and in so doing, a workpiece contact element (WCE) is retracted relative to the tool housing. User depression of a trigger activates a trigger valve, which directs pneumatic pressure within the tool such that a piston is driven down a sleeve or cylinder to impact and drive a fastener into the workpiece.

Pneumatic nailers have traditionally been equipped with sleeves or cylinders made of metal, such as cast aluminum or the like. Due to a motivation for reducing cost and weight for such tools, sleeves made of plastic have been used with some success in relatively smaller pneumatic nailers such as trim tools and staplers. Such sleeves are preferably made by injection molding. These tools generate relatively less energy than that generated in a relatively larger framing tool. Due to the increased operational stresses and power generated by framing tools, plastic sleeves have not previously been suitable, and have failed when applied to such tools. However, there is still a desire by manufacturers to provide pneumatic framing tools with the advantages of reduced cost and weight obtained by smaller tools in converting to plastic sleeves.

SUMMARY

The above-listed drawback is addressed by the present plastic sleeve, which is suitable for use in a pneumatic framing tool. By adding a metal reinforcing ring, the present sleeve offers the durability of a metal sleeve, with the weight and cost savings of a plastic sleeve. The metal reinforcing ring prevents the premature flexing and cracking which resulted in premature failure experienced by completely plastic sleeves when used in pneumatic framing tools. An important feature of the present sleeve is that the metal ring is integrally bonded to the plastic sleeve to provide a unitary component.

Another feature of the present sleeve is that the reinforcing ring has solid walls and is secured to the plastic sleeve below the vent openings conventionally provided to such sleeves for venting the air forced down the sleeve through the action of the piston during a power stroke. Flexing at these openings has previously caused failure in plastic sleeves used in pneumatic framing nailers. In addition, the plastic of the present sleeve has been selected to have a greater glass-filled content and to thus be less prone to expand due to hygroscopic moisture growth, and accordingly is stronger than prior art plastic sleeves.

More specifically, a sleeve for a pneumatic nailer is provided that includes a cylindrical tubular body made of plastic and having a lower edge; and a metal reinforcing ring is integrally secured to the lower edge.

In another embodiment, a sleeve for a pneumatic nailer is provided, including a cylindrical tubular body made of plastic, having a lower edge and a plurality of vent openings adjacent the lower edge, and a metal reinforcing ring integrally secured to the lower edge, the ring having an upper margin located below the openings for reinforcing the body against flexing.

In still another embodiment, a pneumatic framing nailer is provided, including a housing enclosing a power source and having a handle, a nosepiece depending from the housing, and a magazine connected to the nosepiece and configured for sequentially delivering fasteners. The power source includes a sleeve defining a pathway for a reciprocating piston and driver blade, and the sleeve has a cylindrical tubular body made of plastic and has a lower edge, with a metal reinforcing ring integrally secured to the lower edge.

DETAILED DESCRIPTION

Figure 1:
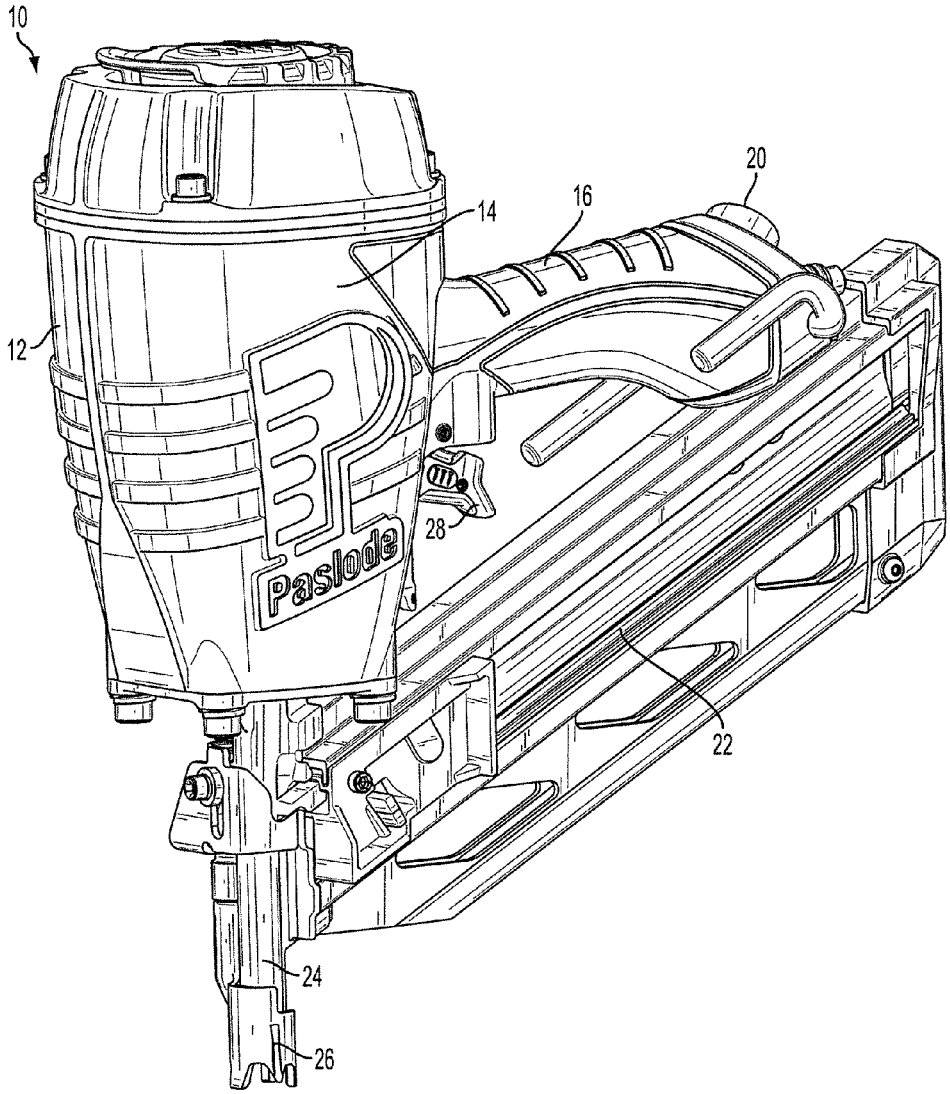
FIG. 1 is a top perspective view of a pneumatic nailer equipped with the present invention.
Figure 2:
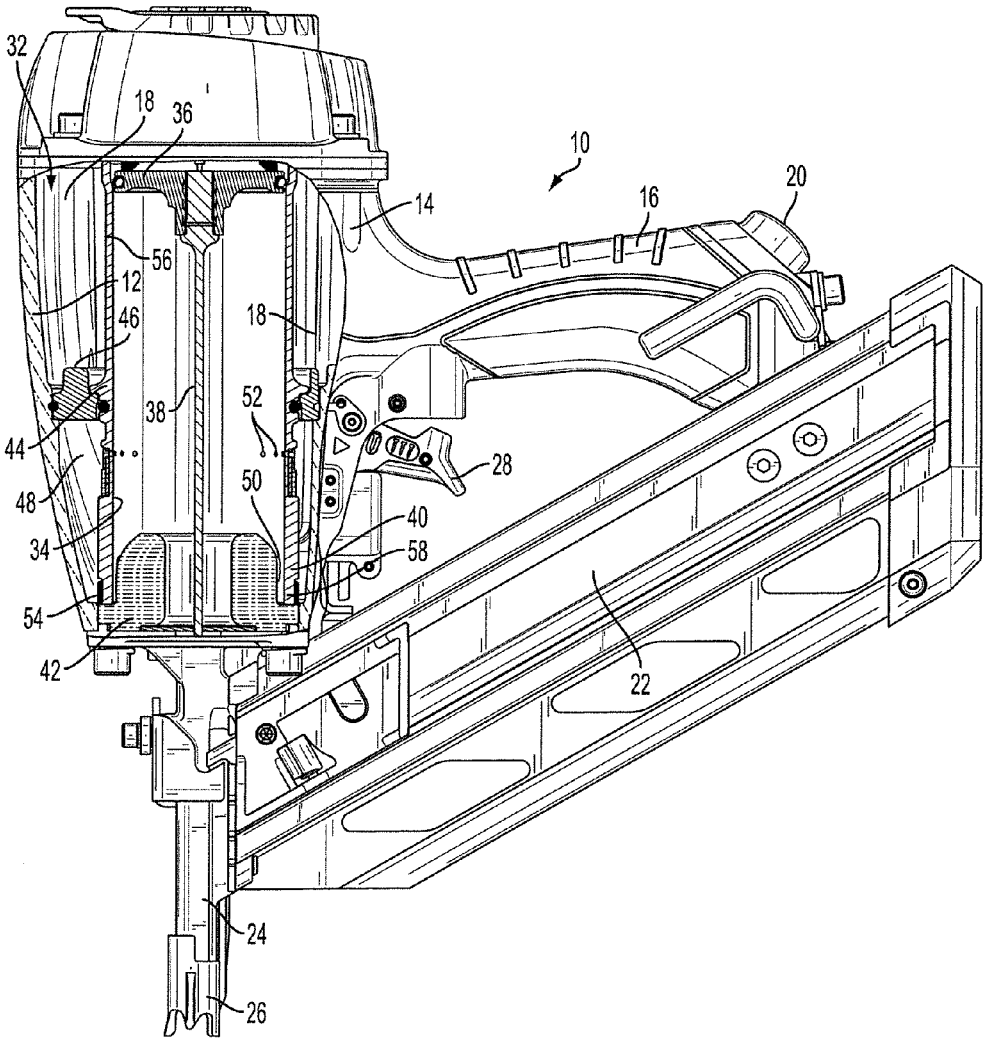
FIG. 2 is a side elevation in partial section of the nailer of FIG. 1 showing the present sleeve.

Referring to FIGS. 1 and 2, a fastener driving nailer or tool, generally designated 10, is preferably pneumatically powered, and more preferably is a framing type tool. This designation is well known in the art, and refers to nailers generating sufficient power for driving fasteners at least as long as 1.5 inches into wooden framing studs. Such nailers generate more power than trim tools and staplers. In the present application, orientation terms such as "vertical," "upper," "lower," "rearward," etc. refer to the tool 10 as depicted in FIGS. 1 and 2.

The tool 10 includes a housing 12 including a generally vertically extending portion 14 and a rearward extending handle 16 defining and enclosing a fluid reservoir 18. A pneumatic air connection 20 such as a nipple is located at a rear of the handle 16. A pressurized line from a compressor (not shown) as is known in the art pressurizes the fluid reservoir 18. Also as is known in the art, a magazine 22 feeds fasteners to a tool nose or nosepiece 24 having a workpiece contact element (WCE) 26, the latter reciprocally slidable relative to the nose so that it retracts upon the user pressing the tool 10 against a workpiece prior to driving a fastener. A trigger 28 controls a trigger valve (not shown). As is the case with conventional pneumatic nailers, in the tool 10 the WCE 26 is mechanically linked to the trigger valve, so that the trigger valve is actuable by movement of the trigger 28 and the WCE concurrently.

Referring now to FIG. 2, the vertically extending housing portion 14 encloses a power source 32 including a cylinder or sleeve 34 accommodating a piston 36 to which is attached a depending driver blade 38 for sequentially engaging and driving fasteners provided by the magazine 22. As is known in the art, the driver blade 38 reciprocates within a passage (not shown) in the nose 24 for engaging the fasteners. At a lower end 40 of the sleeve 34 is disposed a resilient bumper 42 which absorbs impact shock of the piston 36 at a lower end of its power cycle, and facilitates the return of the piston to its pre-driving position seen in FIG. 2.

The sleeve 34 has a radially extending flange 44 sealingly connected to a bulkhead 46 for defining a sealed return chamber 48 below the bulkhead, which is sealed from the pressurized reservoir 18, located above the bulkhead. As is well known in the art of pneumatic tools, the reservoir 18 is pressurized by compressed air entering through the nipple connector 20.

Also provided to the sleeve 34 is a plurality of vent openings 50 for venting air pushed down the sleeve in front of, and by the piston 36 as it drives a fastener. Air behind the piston 36 which pushes it down the sleeve 34 for driving the fastener is allowed to escape through a generally horizontally-arranged row of check valve openings 52, which are in communication with the return chamber 48, proving compressed air to assist the piston 36 back to the pre-driving position at the completion of the fastener driving cycle.

Figure 3:
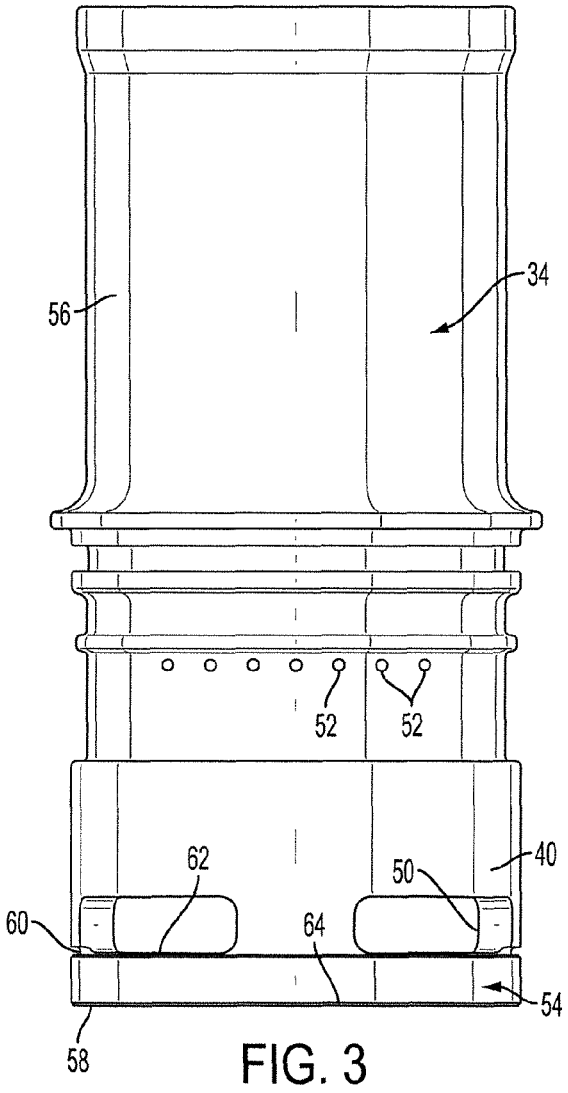
FIG. 3 is a side elevation of the present sleeve equipped with a reinforcing ring.

Referring now to FIGS. 2 and 3, a main feature of the present tool 10 is that the sleeve 34 is made of plastic. While plastic sleeves are known in the pneumatic tool art, until the present invention, there has not been a commercial embodiment of a pneumatic framing tool with a plastic sleeve. Applicant has achieved a reliable plastic sleeve for a pneumatic framing nailer by using a metal reinforcing ring 54, combined with the manner of fastening the ring to the sleeve 34, as well as the location of the ring on the sleeve.

More specifically, the present sleeve 34 has a tubular, generally cylindrical body 56 preferably made of a reinforced plastic material such as Celstran® aramid fiber reinforced nylon 6/6 having fibers in the range of 20-60%. Celstran® fiber reinforced nylon is made by Ticona, Auburn Hills, Mich., and is a preferred form of long fiber-reinforced thermoplastics (LFRT) made by pultrusion so that the fibers are fully impregnated into the plastic for enhanced reinforcement. In the preferred embodiment, the fibers measure about 10 mm long. The resulting material is relatively strong and is better able to withstand the stresses generated during operation of the present pneumatic framing nailer 10. In addition, this preferred material is resistant to hygroscopic expansion which causes unwanted flexing of the sleeve 34 and in some cases has increased cracking and sleeve failure.

On a lower edge 58 of the sleeve body 56 is disposed the metal reinforcing ring 54. While other materials are contemplated, it is preferred that the reinforcing ring 54 is made of steel or stainless steel. It is especially preferred that the ring 54 is secured to the sleeve body 56 so that it becomes an integral component of the sleeve. Contemplated attachment techniques include press fitting, insert molding and the like to ensure that the ring 54 is integrally joined to the sleeve 34. The reinforcing ring 54 has an upper margin 60 which is generally aligned with a lower margin 62 of at least one of the vent openings 50. Thus, the reinforcing ring is located below the vent openings 50. Enhanced results have been achieved when the upper ring margin 60 is aligned with the lower margins 62 of all of the vent openings 50. A lower ring margin 64 is preferably aligned with the lower edge 58 of the sleeve 34.

It has been found that the combination of a relatively stronger, more stable plastic for forming the sleeve body 56, and the integral formation of the reinforcing ring 54 at the lower edge 58 of the sleeve 34 below the vent openings 50 has provided a sufficiently strong and durable plastic sleeve that is not subject to expansion and cracking previously encountered when such sleeves were placed in pneumatic framing tools.

Thus, Applicant has provided a design which enables the advantages of lower weight and cost to be incorporated into pneumatic framing tools.

While a particular embodiment of the present reinforced plastic sleeve for a pneumatic nailer has been described herein, it will be appreciated by those skilled in the art that changes and modifications may be made thereto without departing from the invention in its broader aspects and as set forth in the following claims.

What is claimed is:

1. A sleeve for a pneumatic nailer, comprising:

a cylindrical tubular body made of plastic and having a lower edge and at least one vent opening adjacent said lower edge; and a metal reinforcing ring integrally secured to said lower edge and positioned relative to said at least one vent opening so that said at least one opening remains obstruction free.

2. The sleeve of claim 1 wherein said reinforcing ring has an upper margin located below said at least one vent opening.

3. The sleeve of claim 2 wherein said upper margin of said reinforcing ring is generally aligned with a lower margin of said at least one vent opening.

4. The sleeve of claim 1 wherein said body is made of Celstran® aramid fiber reinforced nylon 6/6 having fibers in the range of 20-60%.

5. The sleeve of claim 1 wherein said reinforcing ring is made of one of steel and stainless steel.

6. A sleeve for a pneumatic nailer, comprising:

a cylindrical tubular body made of plastic, having a lower edge and a plurality of vent openings adjacent said lower edge; and a metal reinforcing ring integrally secured to said lower edge, said ring having an upper margin located below said openings for reinforcing said body against flexing.

7. The sleeve of claim 6 wherein said body is made of a pultruded long fiber reinforced thermoplastic.

8. The sleeve of claim 7 wherein said upper margin of said reinforcing ring is generally aligned with a lower margin of at least one of said vent openings.

9. A pneumatic framing nailer, comprising:

a housing enclosing a power source and including a handle;

a nosepiece depending from said housing;

a magazine connected to said nosepiece and delivering fasteners sequentially to said nosepiece;

said power source including a sleeve defining a pathway for a reciprocating piston and driver blade;

said sleeve having a cylindrical tubular body made of plastic and having at least one vent opening adjacent a lower edge, with a metal reinforcing ring integrally secured to said lower edge; and an upper margin of said reinforcing ring is generally aligned with a lower margin of said at least one vent opening.

* * * * *